US012709843B2

(12) United States Patent
Hausmann

(10) Patent No.: US 12,709,843 B2
(45) Date of Patent: Aug. 18, 2026

(54) PROCESS FOR THE PRETREATMENT OF FIBROUS MATERIAL, PRETREATMENT CHAMBER AND FIBER MOLDING PLANT

(71) Applicant: Kiefel GmbH, Freilassing (DE)

(72) Inventor: Matthias Hausmann, Unken (AT)

(73) Assignee: Kiefel GmbH, Freilassing (DE)

( * ) Notice: Subject to any disclaimer, the term of this patent is extended or adjusted under 35 U.S.C. 154(b) by 140 days.

(21) Appl. No.: 18/741,970

(22) Filed: Jun. 13, 2024

(65) Prior Publication Data

US 2024/0417928 A1 Dec. 19, 2024

(30) Foreign Application Priority Data

Jun. 16, 2023 (DE) ..... 10 2023 115 826.0

(51) Int. Cl.
*D21G 7/00* (2006.01)
*D21J 3/00* (2006.01)

(52) U.S. Cl.
CPC . *D21G 7/00* (2013.01); *D21J 3/00* (2013.01)

(58) Field of Classification Search
CPC ..... D21G 7/00
USPC ..... 162/218
See application file for complete search history.

(56) References Cited

U.S. PATENT DOCUMENTS 6,105,276 A * 8/2000 Ensign ..... D21F 11/14 34/453
2011/0039673 A1 2/2011 Treccani et al.
2022/0339900 A1 10/2022 Moessnang
2023/0272583 A1* 8/2023 Haux ..... D21F 7/008 162/207

FOREIGN PATENT DOCUMENTS

DE 505 991 C 8/1930
DE 10 2015 105 099 A1 10/2016
DE 10 2021 114742 A1 12/2022
EP 4 292 805 A1 12/2023
WO 2004/022327 A1 3/2004
WO 2022/129580 A1 6/2022
WO WO2022258709 A * 12/2022

OTHER PUBLICATIONS

WIPO doc (Year: 2022).*
Extended European Search Report in Appl. No. 24180647.0 mailed Nov. 5, 2024, 11 pages.
German Search Report in DE Appl. No. 10 2023 115 826.0 mailed Apr. 10, 2024, 5 pages.

* cited by examiner

*Primary Examiner* — Jacob T Minskey
(74) *Attorney, Agent, or Firm* — Kowert, Hood, Munyon, Rankin & Goetzel, P.C.; Gareth M. Sampson; Dean M. Munyon

(57) ABSTRACT

The present disclosure relates to a process for the pretreatment of fibrous material in a production process for producing three-dimensional products, to a pretreatment chamber for the pretreatment of fibrous material, and to a fiber molding plant having at least one pretreatment chamber. By pretreating relatively dry fiber material, the shaping step in a manufacturing process can be significantly improved and the choice of product geometries can be increased.

16 Claims, 1 Drawing Sheet

PROCESS FOR THE PRETREATMENT OF FIBROUS MATERIAL, PRETREATMENT CHAMBER AND FIBER MOLDING PLANT

PRIORITY CLAIM

The present application claims priority under 35 U.S.C. § 119 to German Patent Application No. DE 10 2023 115 826.0, filed Jun. 16, 2023, the disclosure of which is incorporated by reference herein in its entirety.

TECHNICAL FIELD

The disclosed embodiments relate to a process for the pretreatment of fibrous material in a production process for producing three-dimensional products, to a pretreatment chamber for the pretreatment of fibrous material, and to a fiber molding plant having at least one pretreatment chamber.

DESCRIPTION OF RELATED ART

Fibrous materials are frequently used, for example, to produce packaging for food (e.g., bowls, capsules, boxes, lids, etc.) and consumer goods (e.g., electronic devices, etc.), as well as beverage containers. Everyday items, such as disposable cutlery and tableware, are also made from fiber-containing material. Fibrous materials contain natural fibers or artificial fibers. Recently, fibrous material has been increasingly used that has or is made of natural fibers that can be obtained, for example, from renewable raw materials or waste paper.

Fibrous materials can be processed in a damp state or a dry state. For example, fibers can be separated and the separated fibers can be joined to form a nonwoven-like layer, where the nonwoven-like layer can subsequently be processed further. The water content can here, for example, be in a range of 0 to 60% by weight.

Dry processing is usually termed "dry fiber" processing. In dry processing, the moisture content can be 0 to 40% by weight, for example.

So-called dry fiber processes include, for example, paper, cardboard, airlaid, compressed airlaid and nonwoven thermoforming processes. Airlaid refers to individual fibers or fiber bundles that are sucked in via a screen belt and deposited thereon to form a relatively loose fiber composite. With compressed airlaid, these fiber layers can then be pressed. Alternatively, preforms with a geometry similar to that of a product to be manufactured can also be preformed.

BACKGROUND

However, dry fiber thermoforming processes are subject to significant limitations in terms of molding ability. The reason for this is the material properties of natural fibers when dry. Depending on the fibrous material used, the maximum elongation is 2-5% relative to the initial state. Furthermore, fibrous material has poor flow behavior. This severely limits the range of possible product geometries (depth, ribs, undercuts, draft angles <10°, etc.) for products made from a fibrous material.

Paper in particular can only be deformed to a very limited extent, as it begins to tear easily when deformed. Fluff-pulp materials (e.g. airlaid) are easier to shape than paper. However, molding is limited by the material thickness of the layer, since the flow of fibers in the material leads to an undesirable thinning of the layer.

The manufacture of products from a fibrous material is known, for example, from WO 2017/160218 A1.

SUMMARY

Object

Thus, it is an object of the present disclosure to provide a solution for producing three-dimensional products from a fibrous material that eliminates the disadvantages of the prior art and provides for the production of three-dimensional products from fibrous material, which solution is substantially not subject to any restrictions with regard to the mold depth and product geometry when producing three-dimensional products in a "dry fiber" processing method.

Solution

The above-mentioned object is achieved by a method for the pretreatment of fibrous material that has a water content of less than 30% by weight in a production process for producing three-dimensional products, where fibrous material is subjected to product-specific pretreatment before at least one process step for shaping three-dimensional products, which takes place directly after the pretreatment of the fibrous material, where the fibrous material is at least partially moistened during the product-specific pretreatment.

The pretreatment of the fibrous material, which is supplied as a raw material/semi-finished product for the manufacture of products, enables the production of products with high mold depths, ribs, or other designs by moistening the fibrous material in selectable regions, which designs could not previously be achieved due to the dry state of the starting material. In particular, moistening the fibrous material expands the process window.

What matters is that not all of the fibrous material needs to be moistened; rather, only the regions of a fibrous material that are subject to greater deformation (e.g. side walls of cups with draft angles >10°) in a subsequent molding process are targetedly moistened so that the fibrous material can be deformed more strongly in these regions. It has been found that fibrous material with a moisture content greater than 20% by weight exhibits better flow behavior without significantly weakening the material layer in this region. Pretreatment and moistening are carried out on a product-specific basis, so that regions that are not subject to subsequent deformation are not moistened or are moistened to a lesser extent, for example.

Regions of the fibrous material can be moistened in different ways for a product so that correspondingly different mold depths can be achieved together with the same material thickness of the finished product and the same product quality.

In embodiments in which a material web is supplied for pretreatment, products are manufactured from regions within the material web. The regions in between are not deformed and can then be reused or disposed of. The regions not required are not moistened in the process described above.

Advantageously, pretreatment is carried out in a manufacturing process immediately before further processing (e.g. shaping by pressing with high pressure/temperature). This can prevent, for example, an expansion of moistened regions, whereby introduced water flows in the fibrous material. The drier the fibrous starting material is, the greater the expansion of the moistened region can be. If moistening occurs immediately before shaping during a manufacturing process, the risk of damage to the fibrous material is reduced or eliminated. In a subsequent molding process, the previously introduced moisture is removed again due to the high pressure (e.g. 500 N/cm$^2$ specific surface pressure) and the high temperature (e.g. 150° C.-200° C.), so that the final product has a uniform moisture content across all regions and surfaces. Therefore, no expansion of moistened regions occurs after the shaping process.

In further embodiments, the fibrous material can undergo at least one temperature, moisture and/or steam treatment and/or additive treatment during the product-specific pretreatment. Treatment can be carried out, for example, by spraying regions and/or by targeted heating (e.g. using infrared radiation or heating punches). Furthermore, the fibrous material can be exposed to a moist climate, for example within a chamber, where the surface of the fibrous material is moistened and/or mixed with additives and admixtures, for example. With an optional or additional temperature treatment, the properties of the fibrous material can be improved. The improvement of the properties of the fibrous material primarily refers to properties that are crucial for a subsequent processing step, such as a molding process. In addition, properties of the final product can also be influenced, where such treatment often takes place after a molding process, since deformation can, for example, damage a previously applied barrier layer.

Introducing steam into the material can also cause it to heat up. For example, the temperature can be reduced in a subsequent pressing step.

In further embodiments, pretreatment can involve at least one pretreatment step.

In further embodiments, selective pretreatment of the fibrous material can be carried out. Selective pretreatment, which depends on the product geometry of the product to be manufactured, can, for example, include different pretreatment of regions. For example, to achieve homogeneous barrier properties for a finished product, uneven coating or pretreatment can be carried out such that the final product still has a uniform layer thickness (e.g. barrier layer) in accordance with the shaping process. In further designs, regions can be subjected to high moisture (20-50%), where the humidification of the entire region of a fibrous material for a product remains below 20% in total in order to avoid steam explosions in the molding process.

In further designs, the fibrous material can be supplied for pretreatment in the form of separate preforms, as sheets or as a continuous web.

In further embodiments, during selective pretreatment, only regions that are deformed in a subsequent process step can be pretreated so that uniform product quality and uniform properties of a finished product can be achieved.

In further embodiments, pretreatment can be carried out on the surface of the fibrous material from at least one side. The fibrous material is usually guided through the pretreatment in a transport direction, and has, for example, a bottom side and a top side. In this case, pretreatment can, for example, only affect the bottom side or the top side. In other embodiments, pretreatment can also be carried out on the bottom side and the top side. In other embodiments, pretreatment can be alternately carried out on a top side and a bottom side.

In further embodiments, pretreatment can be carried out in a plurality of pretreatment steps, where different pretreatments can be carried out in the pretreatment steps, which can be coordinated in their sequence, depending on the requirements, or can take place in any order.

In further embodiments, pretreatment can take place within a pretreatment chamber in which the fibrous material is at least temporarily protected against external influences. Such pretreatment can be used, for example, to carry out special pretreatments in an atmosphere (pressure, temperature, (air) moisture) that differs from the atmosphere of the manufacturing process and/or of a manufacturing site. For temporary decoupling of the interior of a pretreatment chamber, appropriate means can be provided, such as movable flaps or the like.

In further embodiments, at least one portion of the pretreatment chamber may include different properties than the region around the pretreatment chamber, where the properties include pressure, temperature and/or moisture.

In further embodiments, the quality and the appearance and/or properties of products can be checked and evaluated using additional devices (sensors, cameras, etc.). If deviations from a target value are detected, process parameters of the pretreatment process can be adjusted and changed directly via a controller, where, for example, regions are moistened to a greater or lesser extent, and/or a local adjustment (e.g. by changing the orientation of nozzles, etc.) of the regions of the fibrous material to be moistened can be made. In other embodiments, the temperature and/or the throughput speed can also be adjusted during pretreatment.

In further embodiments, a first pretreatment step can be carried out before a first further processing step, with at least one second pretreatment then being carried out before at least one second further processing step. For example, pretreatment can initially be carried out in which regions of fibrous material are moistened and then preformed. This is followed by further moistening of regions that are then finally shaped in a final second molding station. The step-by-step pretreatment and/or moistening thus always takes place immediately before the corresponding further processing step or molding process so that the properties of the fibrous material are specifically influenced for the next processing step.

The above-mentioned object is also achieved by a pretreatment chamber for the pretreatment of fibrous material that has a water content of less than 30% by weight, where the pretreatment chamber is part of a fiber molding plant for producing three-dimensional products, where product-specific pretreatment of the fibrous material can be carried out in the pretreatment chamber, and said pretreatment chamber has at least one pretreatment device with which fibrous material introduced therein undergoes at least one temperature, moisture and/or steam treatment and/or an additive treatment.

Furthermore, the above-mentioned object is achieved by a fiber molding plant that has at least one pretreatment chamber according to at least one of the above embodiments, where the at least one pretreatment chamber is arranged upstream of at least one molding station.

The above statements regarding pretreatment apply accordingly to a pretreatment chamber and to a fiber molding plant having such a pretreatment chamber.

Further features, embodiments and advantages result from the following illustration of exemplary embodiments with reference to the figures.

DETAILED DESCRIPTION

Embodiments of the technical teaching described herein are shown below with reference to the drawings. Identical reference signs are used in the figure description for identical components, parts and processes. Components, parts and processes that are not essential to the technical teachings disclosed herein or that are obvious to a person skilled in the art are not explicitly reproduced. Features specified in the singular also include the plural unless explicitly stated otherwise. This applies in particular to statements such as "a" or "one."

The drawings show embodiments of a fiber molding plant 100 having at least one pretreatment chamber 120; 140 and at least one molding station 130; 150. The exemplary embodiments shown here do not represent any restriction with regard to further embodiments and modifications of the described embodiments. Thus, alternative embodiments for individual exemplary embodiments can also be provided alternatively or cumulatively in other exemplary embodiments.

Figure 1:
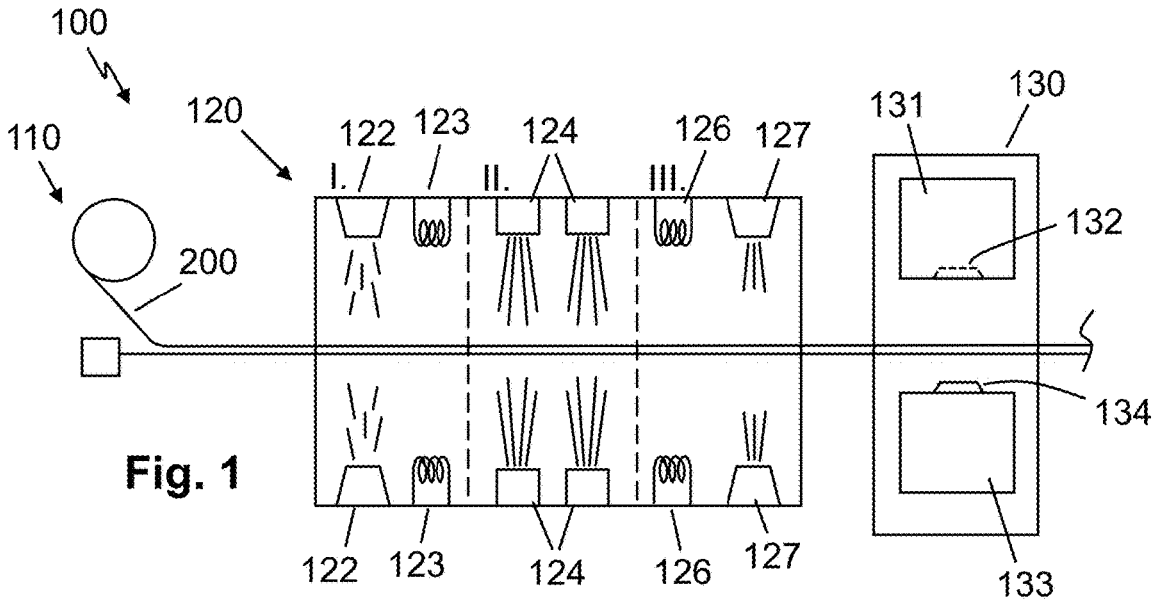
FIG. 1 depicts a schematic view of a fiber molding plant for producing three-dimensional products from a fibrous material, according to some embodiments.

FIG. 1 is a schematic view of a fiber molding plant for producing three-dimensional products from a fibrous material. The fiber molding plant 100 makes it possible to produce products that are biodegradable and can themselves again serve as a starting material for the production of three-dimensional products from a fibrous material, and can be composted because they can generally be fully decomposed and do not contain any worrying, environmentally hazardous substances. The products can, for example, be designed as cups, lids, bowls, capsules, plates and further molded and/or packaging parts (e.g., as holding/support structures for electronic devices or other devices).

In the embodiment shown, a material web 200 made of a fibrous material is processed. The material web 200 contains fibers of natural origin and has a moisture content of less than 30% by weight of water.

In the illustrated embodiment, the fiber molding plant 100 has a feeder 110. The feeder 110 can, as schematically indicated, also have a transport device that serves to transport a material web 200, web sections or premolded preforms. The transport device can have different designs. Depending on the design of a pretreatment chamber 120; 140, a transport device can also support or hold a material web 200 or other fibrous material, only in certain regions, in order to also enable treatment from the bottom side. In the design shown, a material web 200 is unwound from a roll and fed continuously in the processing direction to a first pretreatment chamber 120. The material web 200 passes through the first pretreatment chamber 120 and is subjected to three pretreatment steps (I., II., III.). During pretreatment, properties of the material web 200 are selectively influenced in a product-specific manner in order to immediately subsequent shaping is supported or only possible. For this purpose, the material web 200 is fed to a first molding station 130 after pretreatment. In the molding station 130, regions of the material web 200 are deformed and receive their final three-dimensional shape.

The feed of the material web 200 can be carried out continuously or cyclically via the feeder 110. In the embodiment shown, pretreatment and shaping take place during a feed pause. To ensure continuous unwinding of the material web 200, length compensation devices can be provided, as are known, for example, in thermoforming systems for plastics films.

The fiber molding plant 100 may have additional stations and devices. For example, a reserve may be provided for fibrous material. In further designs, a grinder can be provided for comminuting a starting material and for separating fibers, which can then be pretreated as an "airlaid" material.

The pretreatment chamber 120 may include a housing that surrounds the space where pretreatment takes place. The pretreatment chamber 120 has a passage on the inlet and outlet sides, which can be closed in other designs. Thus, the space within the pretreatment chamber 120 can be substantially sealed and/or decoupled from its surroundings so that other conditions (temperature, moisture, pressure) can prevail within the pretreatment chamber 120, at least temporarily.

In the embodiment shown in FIG. 1, the pretreatment chamber 120 has a first portion I., a second portion II. and a third portion III., which in further embodiments can be separated from one another and sealed off, or at least are separable and sealable.

The pretreatment chamber 120 has at least one first spraying device 122 and at least one first heating device 123 in the first portion I. The second portion II. includes second spraying devices 124. The third portion III. has at least one second heating device 126 and third spraying devices 127.

The at least one first molding station 130 has an upper first tool part 131 and a lower second tool part 133. The first tool part 131 has a plurality of cavities 132, and the second tool part 133 has a plurality of corresponding mold parts 134. In order to mold products, the two tool parts 131 and 133 are moved relative to each other, where the pretreated regions of the material web 200 are pressed between the surfaces of the cavities 132 and the molded parts 134 by applying pressure and heat. For example, pressing can be carried out under specific pressures in the range of 100 $N/cm^2$ to 5,000 $N/cm^2$ and temperatures of 20 (cold pressing) to 250° C. (hot pressing).

After the deformation/pressing in the molding station 130, the pressed products are fed in the transport direction to a further station and/or removed from the fiber molding plant 100. Optional post-processing of the manufactured products may include printing, dyeing, filling, stacking, etc. This can be done, for example, in at least one processing station 160, as shown schematically in FIG. 3.

In the first portion I., during a first pretreatment step, first regions 210 are first sprayed by the first spraying devices 122 with an additive that changes or influences the properties of the fibrous material in the sprayed region. For example, additives can be applied to the surfaces of the material web 200 from both below and from above. As shown schematically in plan view in FIG. 2, spraying is carried out in circles in the region of the dashed line. The regions 210 provided with the additives are then dried in the first portion I. using the first heating devices 123. In order to achieve this, cyclical feed is carried out, where in the embodiment shown the material web 200 is substantially always moved to the right by just one (shown vertically in FIG. 2) row of regions 210.

The material web 200 is then moved further. The regions 210 previously provided with additives and dried are then subjected to further pretreatment in the second portion II. by means of the second spraying devices 124. The second spraying devices 124 can, for example, moisten a portion 220 of the material web 200 and thus increase the moisture content. For example, additional additives can be applied. In further embodiments, the entire fibrous material of the portion 220 of the material web 200 is permeated by steam in the second portion II.

The material web 200 is then moved to a third portion III, in which the material web 200 is initially dried by the second heating devices. Subsequently, regions 230 are also moistened by the third spraying devices 127.

Figure 2:
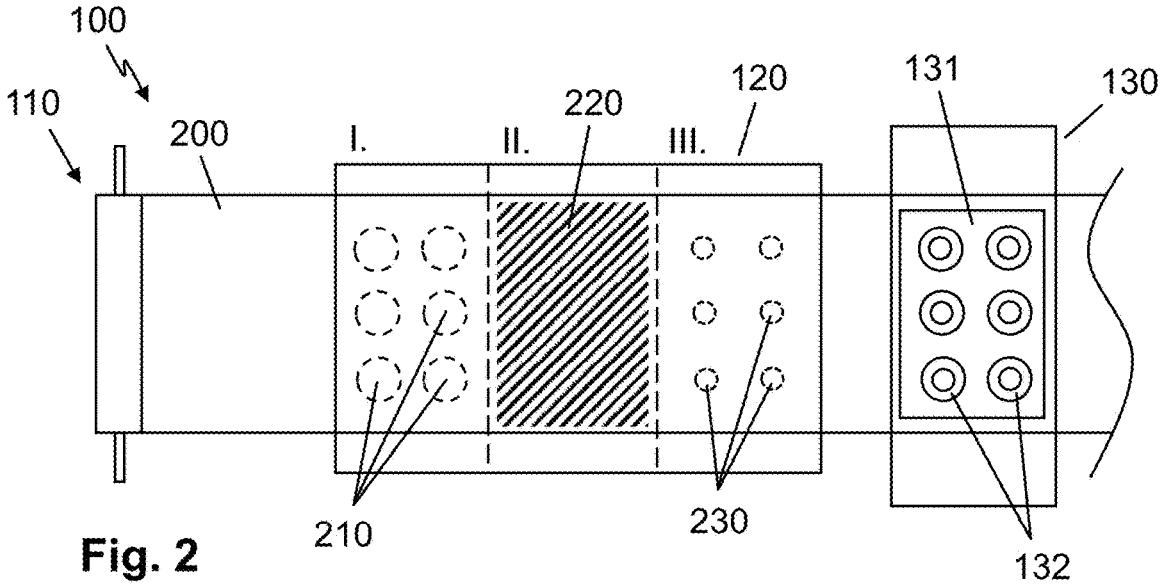
FIG. 2 depicts a further schematic view of a fiber molding plant for producing three-dimensional products from a fibrous material, according to some embodiments.

As shown in FIG. 2, the regions 210, 230 differ so that different material properties of the fibrous material of the material web can be achieved by the fact they have a different moisture content. In the embodiment shown, inclined surfaces are subject to greater deformation during pressing in the molding station 130 so that the fibrous material in these regions must have different properties with regard to deformability than, for example, in a base region of a bowl, cup or lid to be produced. This is achieved by product-specific selective moistening of regions of the fibrous material, which can be subjected to stronger/greater deformation in moist regions than in other regions.

For example, regions of the fibrous material can be moistened with from 20 to 50 wt. % water. In order to prevent damage to the material during subsequent pressing at high temperatures, the total moisture content of the material in a mold space between the surfaces of a cavity 132 and a corresponding molded part 134 can be adjusted so that it does not exceed, for example, 20% by weight. The adjustment is made according to the moisture content of the corresponding regions.

For controlling the production steps and the pretreatment, the fiber molding plant 100 also has at least one controller, which in further embodiments is connected to at least one monitoring device (e.g. camera, sensors, etc.) in order to adapt and regulate the moisture content of regions of the fibrous material and the pretreatment.

Figure 3:
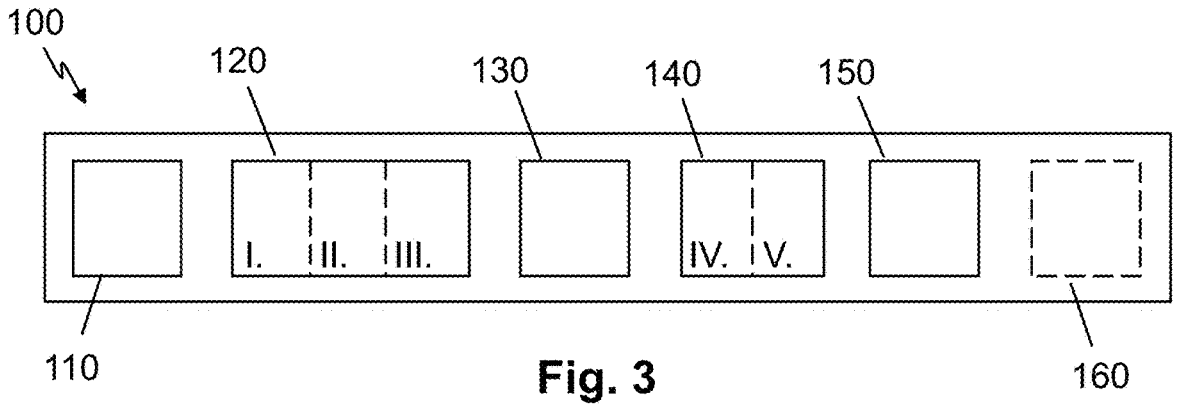
FIG. 3 depicts a schematic view of a further fiber molding plant for producing three-dimensional products from a fibrous material, according to some embodiments.

FIG. 3 is a schematic view of a further fiber molding plant 100 for producing three-dimensional products from a fibrous material, which additionally has at least one second pretreatment chamber 140 and a second molding station 150. The second pretreatment chamber 140 has a fourth portion IV. and a V. portion in which further additives and/or product-specific moistening of surfaces of the material web 200 to be deformed takes place.

For example, in the first pretreatment chamber 120, in addition to the application or introduction of additives, moistening can take place for preforming the fibrous material. In this case, the fibrous material is preformed immediately after the first pretreatment so that it substantially already assumes the shape of the product to be manufactured. Subsequently, further additives (e.g. for a barrier) can be applied in the second pretreatment chamber 140; in addition, regions to be molded can be (re) moistened. The final molding and/or pressing step can then take place in the second molding station 150.

In further embodiments, for example, in a second molding step in a second molding station 150, grooves can be formed in an already shaped inclined side wall. Other embossed elements can also be introduced in different designs.

In addition, the surface finish and properties of the product to be manufactured can be significantly influenced and improved in a two-step molding or pressing process. For example, after a first molding step, the entire product, for example, can be moistened again and/or post-pressed with a different pressure and/or temperature.

Direct (inline) product-specific pretreatment of fibrous material is described, which enables an automatic "dry fiber" manufacturing process in a fiber molding plant 100, where there are no restrictions with regard to the product geometry due to the dry fiber material used.

One or more states of the fibrous material can be changed in a pretreatment chamber 120; 140 in one or more segments (I., II., III./IV., V.). The fibrous material can be fed from a roll or in cut pieces and transported through the pretreatment chamber 120; 140. Pretreatment can be carried out on one or both sides, once or in combined applications, continuously or in process steps. In addition, selective pretreatment is carried out, where product geometry-specific regions are given a high amount of moisture (20-50%), for example, but the total moisture content can be limited from a damage/weakening of the material perspective.

In addition to increasing elongation and flow behavior, the strength of the molded products is also increased and the surface becomes smoother and more stable (no "linting"). Advantageously, pretreatment takes place before a process step, in particular a molding step. It is also possible to divide the pretreatment, for example by having a pretreatment step between two process steps, in order to apply moisture locally again after preforming with a hot mold, in order to produce the final product geometry.

Energy is also saved because less moisture is introduced into the material, so less energy is also required to remove the moisture during pressing. In other embodiments, in accordance with the (total) moisture content, "cold" pressing (e.g. at room temperature, approx. 20° C.) can also be carried out, since the moisture can be distributed throughout the product under high pressure and thus does not lead to locally "wet" regions.

LIST OF REFERENCE SIGNS

100 Fiber molding plant
110 Feeder
120 First pretreatment chamber
122 First spraying device
123 First heating device
124 Second spraying device
126 Second heating device
127 Third spraying device
130 First molding station
131 First tool part
132 Cavity
133 Second tool part
134 Molded part
140 Second pretreatment chamber
150 Second molding station
160 Processing station
200 Material web
210 First regions
220 Portion
230 Second regions

The invention claimed is:

1. A process for pretreatment of fibrous material having a water content of less than 30% by weight in a production process for producing three-dimensional products, wherein the fibrous material is subjected to product-specific pretreatment before at least one process step of shaping three-dimensional products, wherein the at least one process step takes place directly after the pretreatment of the fibrous material, and wherein the product-specific pretreatment includes selectively moistening the fibrous material to provide different moisture content in different regions of the fibrous material.

2. The process according to claim 1, wherein during the product-specific pretreatment, the fibrous material undergoes at least one temperature, moisture, and/or steam treatment and/or the fibrous material undergoes an additive treatment.

3. The process according to claim 2, wherein the pretreatment comprises at least two pretreatment steps that include at least two of the temperature, moisture, and steam treatment.

4. The process according to claim 1, wherein the fibrous material is supplied for pretreatment in the form of one of: separate preforms of the fibrous material, as a sheet of the fibrous material, or as a continuous web of the fibrous material.

5. The process according to claim 1, wherein, during the selective moistening, only regions that are deformed in a subsequent process step are moistened.

6. The process according to claim 1, wherein the pretreatment is carried out on a surface of the fibrous material at least from one side.

7. The process according to claim 1, wherein the pretreatment is carried out in a plurality of pretreatment steps.

8. The process according to claim 1, wherein the pretreatment takes place within a pretreatment chamber in which the fibrous material is at least temporarily protected from external influences.

9. The process according to claim 8, wherein at least one portion of the pretreatment chamber has properties that are different from a region around the pretreatment chamber, and wherein the properties include pressure, temperature, and/or moisture.

10. The process according to claim 1, wherein the product-specific pretreatment includes selectively providing additives to the fibrous material in different portions of the fibrous material.

11. The process according to claim 10, wherein the portions are different in size than the regions that are selectively moistened.

12. The process according to claim 10, wherein the regions that are selectively moistened overlap with the portions that are selectively provided additives.

13. The process according to claim 1, wherein the fibrous material is moistened directly before the at least one process step is initiated.

14. A pretreatment chamber for pretreatment of fibrous material that has a water content of less than 30% by weight, wherein the pretreatment chamber is part of a fiber molding plant for producing three-dimensional products, wherein product-specific pretreatment of the fibrous material is configured to be carried out in the pretreatment chamber, and said pretreatment chamber has at least one pretreatment device with which the fibrous material introduced therein undergoes at least one temperature, moisture, and/or steam treatment and/or undergoes an additive treatment, wherein the pretreatment chamber includes at least one portion where the fibrous material is selectively moistened to provide different moisture content in different regions of the fibrous material.

15. A fiber molding plant comprising at least one pretreatment chamber according to claim 14, wherein the at least one pretreatment chamber is arranged upstream of at least one molding station.

16. The pretreatment chamber of claim 14, wherein the pretreatment chamber includes at least one additional portion where the fibrous material is selectively treated with an additive in different portions of the fibrous material.

* * * * *